US007283634B2

(12) United States Patent
Smith

(10) Patent No.: US 7,283,634 B2
(45) Date of Patent: Oct. 16, 2007

(54) METHOD OF MIXING AUDIO CHANNELS USING CORRELATED OUTPUTS

(75) Inventor: William P. Smith, Bangor, Co. Down (IE)

(73) Assignee: DTS, Inc., Agoura Hills, CA (US)

( * ) Notice: Subject to any disclaimer, the term of this patent is extended or adjusted under 35 U.S.C. 154(b) by 182 days.

(21) Appl. No.: 10/930,659

(22) Filed: Aug. 31, 2004

(65) Prior Publication Data

US 2006/0045291 A1 Mar. 2, 2006

(51) Int. Cl.
*H04R 5/00* (2006.01)

(52) U.S. Cl. ..... 381/20

(58) Field of Classification Search ..... 381/1, 381/61, 97–98, 119, 86, 17–23, 27–28
See application file for complete search history.

(56) References Cited

U.S. PATENT DOCUMENTS 3,825,684 A * 7/1974 Ito et al. ..... 381/22
4,819,269 A 4/1989 Klayman
5,128,999 A 7/1992 Yanagawa
5,757,927 A * 5/1998 Gerzon et al. ..... 381/20
5,870,480 A 2/1999 Griesinger
6,624,873 B1 9/2003 Callaham, Jr. et al.
6,760,448 B1 * 7/2004 Gundry ..... 381/23
2002/0067834 A1 * 6/2002 Shirayanagi ..... 381/20
2002/0071574 A1 6/2002 Aylward et al.

* cited by examiner

*Primary Examiner*—Vivian Chin
*Assistant Examiner*—Lun-See Lao
(74) *Attorney, Agent, or Firm*—Eric Gifford

(57) ABSTRACT

A method of mixing audio channels is effective at rebalancing the audio without introducing unwanted artifacts or overly softening the discrete presentation of the original audio. This is accomplished between any two or more input channels by processing the audio channels to generate one or more "correlated" audio signals for each pair of input channels. The in-phase correlated signal representing content in both channels that is the same or very similar with little or no phase or time delay is mixed with the input channels. The present approach may also generate an out-of-phase correlated signal (same or similar signals with appreciable time or phase delay) that is typically discarded and a pair of independent signals (signals not present in the other input channel) that may be mixed with the input channels. The provision of both the in-phase correlated signal and the pair of independent signals makes the present approach well suited for the downmixing of audio channels as well.

3 Claims, 10 Drawing Sheets

METHOD OF MIXING AUDIO CHANNELS USING CORRELATED OUTPUTS

BACKGROUND OF THE INVENTION

1. Field of the Invention

This invention relates to mixing of audio signals and more specifically to a mix or downmix of two or more audio channels using a correlated output.

2. Description of the Related Art

Multi-channel audio has received enthusiastic acceptance by movie watchers in both traditional theater and home theater venues as it provides a true "surround sound" experience far superior to mixed stereo content. Dolby AC3 (Dolby digital) audio coding system is a world-wide standard for encoding stereo and 5.1 channel audio sound tracks. DTS Coherent Acoustics is another frequently used multi-channel audio coding system. DTS Coherent Acoustics is now being used to provide multi-channel music for special events and home listening via broadcast, CDs and DVDs 5.1, 6.1, 7.1, 10.2 and other multi-channel formats Car audio systems have over the years advanced from mono to stereo to the multi-speaker systems standard in most every automobile today. However, most content is still provided in a 2-channel stereo (L,R) format. The audio system mixes and delays the two channels to the multi-speaker lay out to provide an enhanced audio experience. However with the growing availability of multi-channel music, multi-channel audio systems are being implemented in automobiles to provide passengers with a "surround sound" experience.

Although a significant improvement over existing audio systems, the confines of the car and proximity of passengers to particular speakers affect the surround-sound experience. In general, the desired mix embodied in the multi-channel format may become "unbalanced". For example, a passenger sitting in the front passenger's seat may here too much of the discrete R channel that is emanating from the front right speaker effectively losing some of the benefits of the surround sound presentation. Even more extreme, a passenger in the back seat may here only the surround sound channels.

As a result, automakers have found that some amount of remixing of the discrete channels can reestablish the desired balance and improve the surround sound experience for everyone in the car. As shown in FIG. 1, a typical mixer 10 remixes the discrete R,C,L input channels 12,14,16 into R,C,L output channels 18,20,22 for an automobile. Each channel is passed through a delay 24 and mixed (multiplied by gain coefficients Gi 26 and summed 28) with the adjacent channels. Standard mixing equations are:

$$R=G1*R+G2*C$$

$$C=G3*C+G4*L+G5*R, \text{ and}$$

$$L=G6*L+G7*C.$$

The mixed channels are passed through equalizers 30 to the output channels 18,20,22 for playback on the L,C,R channel speakers in the automobile.

Although this approach is generally effective at rebalancing the audio to provide a reasonable surround-sound experience for every passenger in the automobile there are a few potential problems. This approach may introduce unwanted artifacts when two channels include the same or very similar content but with a relative time or phase delay. Furthermore, this approach may over mix the signals that were assigned to a specific channel thereby degrading the "discreteness" of the multi-channel audio.

SUMMARY OF THE INVENTION

The present invention provides a method of mixing audio channels that is effective at rebalancing the audio or downmixing audio channels without introducing unwanted artifacts or overly degrading the discrete presentation of the original audio.

This is accomplished between any two or more input channels by processing the audio channels to generate one or more "correlated" audio signals for each pair of input channels. The correlated audio signal(s) are then mixed with the input audio channels to provide the output channels. The correlator can be implemented using any suitable technology including but not limited to Neural Networks, Independent Component Analysis (ICA), Adaptive Filtering or Matrix Decoders.

In one embodiment, only the in-phase correlated signal is mixed with the two input channels. The in-phase correlated signal represents the same or very similar signals that are present in both channels and in-phase (no or minimal time delay). By mixing only this portion of the audio signals we are able to achieve the desired rebalancing without introducing unwanted artifacts or degrading the discreteness of multi-channel audio.

In another embodiment, the correlation process provides the in-phase correlated signal, an out-of-phase correlated signal (same or similar signals with appreciable time or phase delay) and one or more independent signals (signals not present in the other input channel) that are mixed with the input channels. This approach provides more mixing flexibility. The mixer may set the mixing coefficients of the out-of-phase and independent signals to zero thereby achieving the same results as if only the in-phase correlated signal were mixed. Or the mixer may simply lower the coefficients in these signals to provide a smoother mix. In other applications, the mixer may want to reduce or remove the out-of-phase signal but retain some of the independent signal. For example, in a 3:2 downmix from L,C,R input channels to L,R output channels it may be desirable to mix the independent C channel signals into the L and R output channels.

These and other features and advantages of the invention will be apparent to those skilled in the art from the following detailed description of preferred embodiments, taken together with the accompanying drawings, in which:

DETAILED DESCRIPTION OF THE INVENTION

The application of multi-channel audio to automobiles revealed the desirability for remixing of the discrete audio channels to provide a more uniform surround sound experience for all passengers. However, although a straightforward mix was effective at rebalancing the multi-channel audio this approach could produce unwanted artifacts. If, for example, the R and C channels included the same or very similar content with appreciable phase or time delays, remixing these two channels could produce phase distortion and/or amplitude distortion. Furthermore, much of the desirability of multi-channel audio stems from the discrete unmixed presentation of the audio channels. The remixing process may soften the discrete presentation of the audio.

Therefore, the present invention provides a method of mixing audio channels that is effective at rebalancing the audio without introducing unwanted artifacts or overly softening the discrete presentation of the original audio. This is accomplished between any two or more input channels by processing the audio channels to generate one or more "correlated" audio signals for each pair of input channels. The in-phase correlated signal representing content in both channels that is the same or very similar with little or no phase or time delay is mixed with the input channels. The present approach may also generate an out-of-phase correlated signal (same or similar signals with appreciable time or phase delay) that is typically discarded and a pair of independent signals (signals not present in the other input channel) that may be mixed with the input channels. The provision of both the in-phase correlated signal and the pair of independent signals makes the present approach well suited for the downmixing of audio channels as well.

Although the techniques were developed in the context of improving the surround sound experience provided by multi-channel audio in a automobile, the present invention is generally applicable to any two or more audio channels in which mixing occurs in any setting.

Mixing with Correlated Outputs

Figure 1:
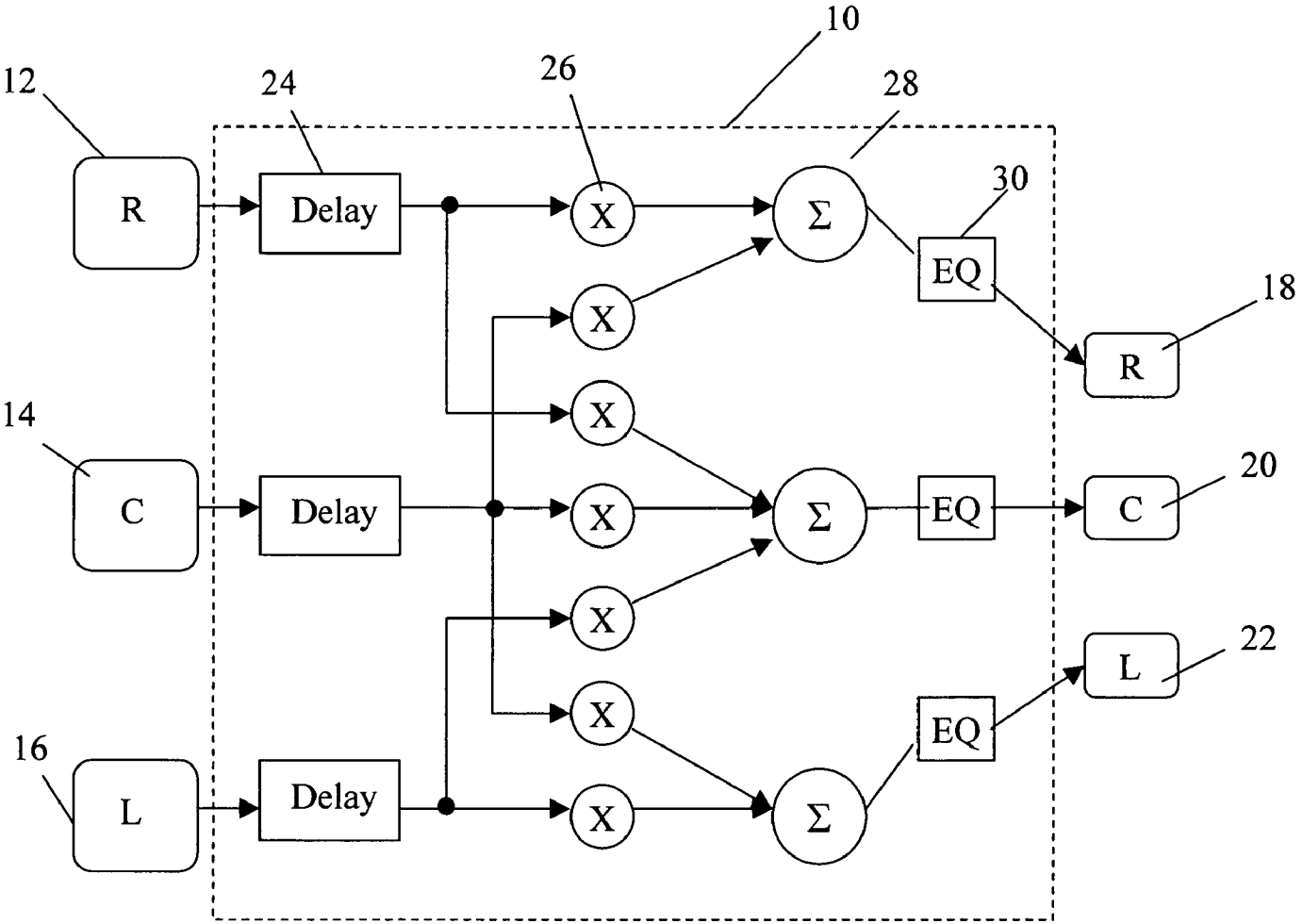
Fig. 1 (Prior Art)
FIG. 1, as described above, is a known configuration for mixing the discrete L, C and R audio channels in an automobile to improve the surround-sound experience.
Figure 2:
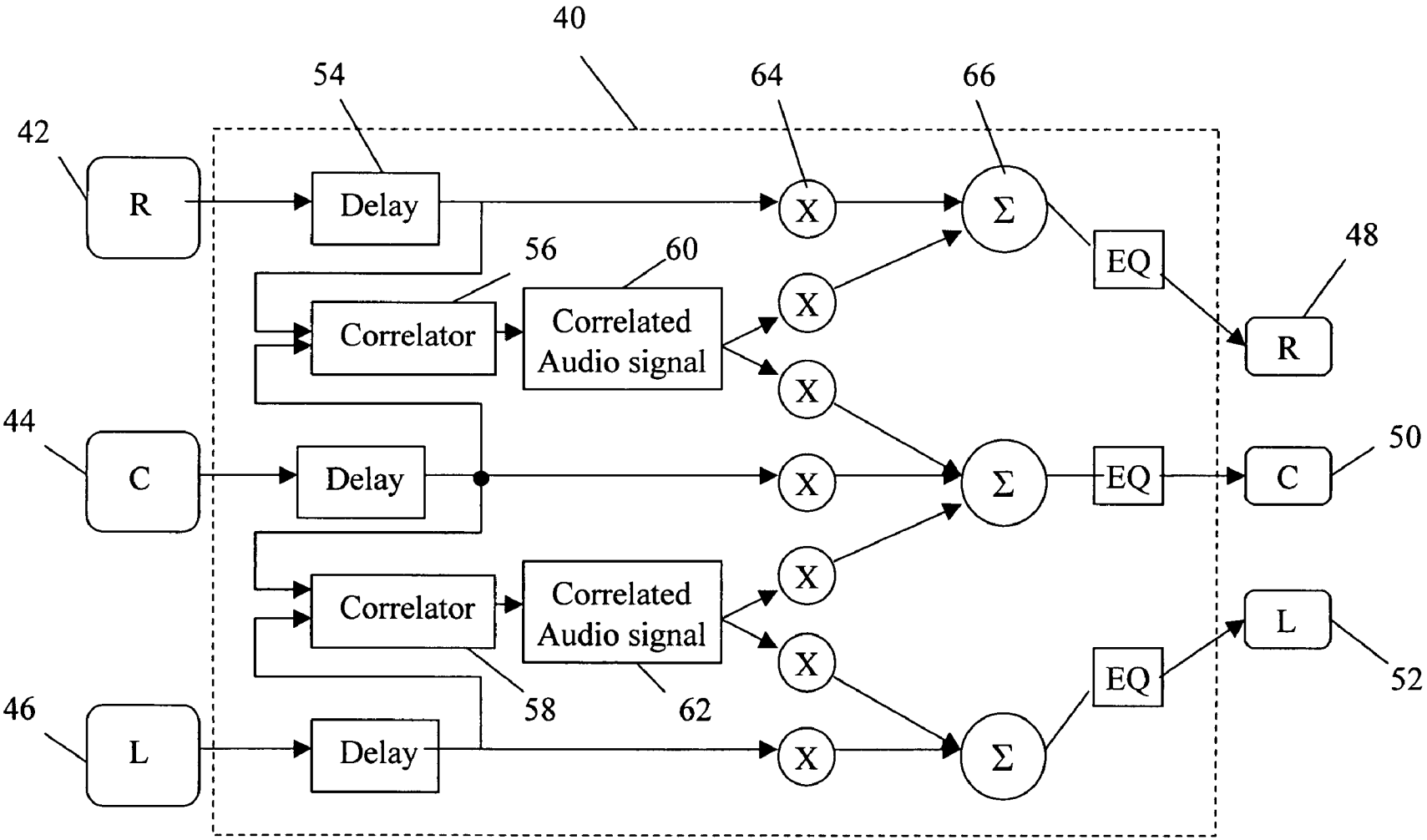
FIG. 2 is a configuration for mixing the discrete L, C and R audio channels using the correlated outputs between the L and C and R and C channels in accordance with the present invention.

As shown in FIG. 2, a mixer 40 remixes the discrete R,C,L input channels 42,44,46 into R,C,L output channels 48,50,52 for an automobile. Each channel is passed through a delay 54. The R and C and L and C channels are input to correlators 56 and 58, respectively, which generate correlated audio signals 60 and 62. These correlated audio signals 60 and 62 are mixed (multiplied by gain coefficients Gi 64 and summed 66) with the adjacent channels. The mixed channels are passed through equalizers 68 to the output channels 48,50,52 for playback on the L,C,R channel speakers in, for example, the automobile.

Figure 3:
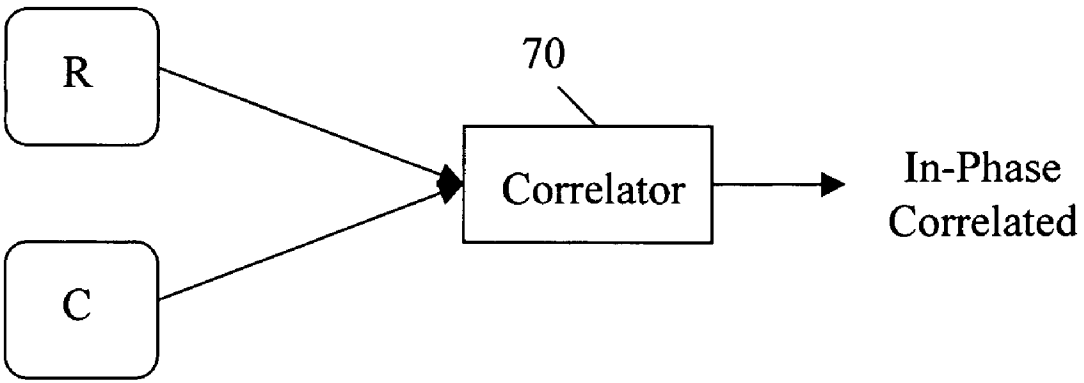
FIG. 3 is a block diagram of a correlator generating a correlated output.

The correlators 56 and 58 can be implemented using any suitable technology including but not limited to Neural Networks, Independent Component Analysis (ICA), Adaptive Filtering or Matrix Decoders. As shown in FIG. 3, a correlator 70 can be configured to produce a single in-phase correlated audio signal (LCC, RCC) that is mixed as follows:

$$R=G8*R+G9*\mathrm{RCC} \tag{1}$$

$$C=G10*C+G11*\mathrm{LCC}+G12*\mathrm{RCC}, \text{ and} \tag{2}$$

$$L=G13*L+G14*\mathrm{LCC}. \tag{3}$$

In this approach, the out-of-phase correlated signals and independent signals are removed. Of course there are no bright lines or clear definitions that separate in-phase from out-of-phase and correlated from independent. How these components of the audio content are separated will depend upon the technology used to implement the correlator and the desired characteristics of the correlated signal. In some applications it may be desirable to retain only very high correlated signals. In other applications, it may be desirable to retain some of the out-of-phase and independent signals.

Figure 4:
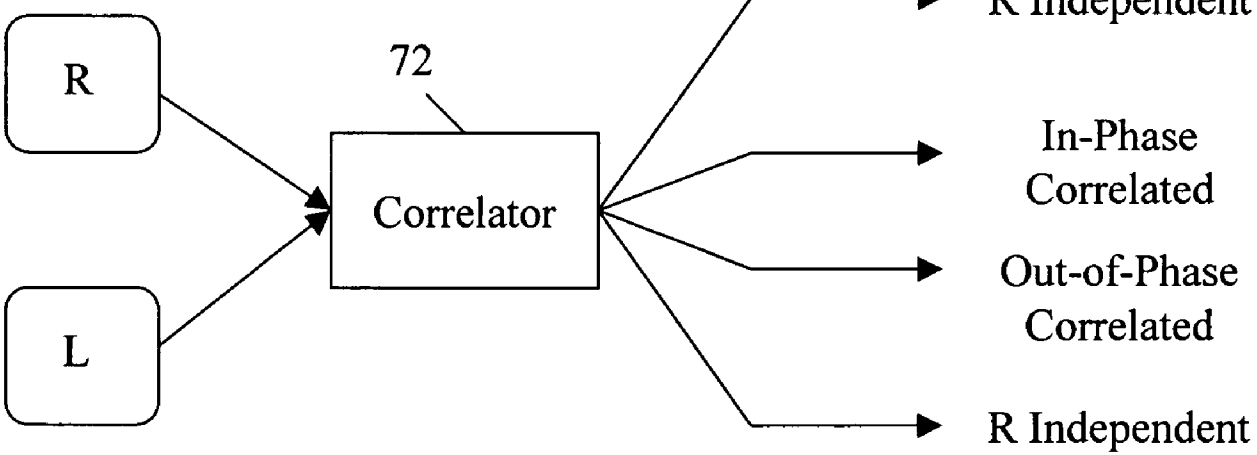
FIG. 4 is a block diagram of a correlator generating correlated, out-of-phase and independent outputs.

As shown in FIG. 4, this desire for increased flexibility can be accommodated with a correlator 72 that is configured to produce an in-phase correlated audio signal (RIP,LIP), an out-of-phase correlated audio signal (ROP,LOP) and L and R independent audio signals (RCI,CRI and LCI,CLI). In general, each of these components can be mixed in accordance with mixing equations:

$$R=G15*R+(G16*\mathrm{RIP}+G17*\mathrm{ROP}+G18*\mathrm{RCI}+G19*\mathrm{CRI}) \tag{4}$$

$$C=G20*C+(G21*\mathrm{LIP}+G22*\mathrm{LOP}+G23*\mathrm{LCI}+G24*\mathrm{CLI})+(G25*\mathrm{RIP}+G26*\mathrm{ROP}+G27*\mathrm{RCI}+G28*\mathrm{CRI}), \text{ and} \tag{5}$$

$$L=G29*L+(G30*\mathrm{LIP}+G31*\mathrm{LOP}+G32*\mathrm{LCI}+G33*\mathrm{CLI}). \tag{6}$$

Similar to above how these different correlated components are computed will depend upon the implementing technology and the desired characteristics of the different components.

In a typical implementation, the out of phase components and the independent components for that output channel may be discarded. In this case the equations simplify to:

$$R=G15*R+(G16*\mathrm{RIP}+G19*\mathrm{CRI}) \tag{7}$$

$$C=G20*C+(G21*\mathrm{LIP}+G23*\mathrm{LCI})+(G25*\mathrm{RIP}+G27*\mathrm{RCI}), \text{ and} \tag{8}$$

$$L=G29*L+(G30*\mathrm{LIP}+G33*\mathrm{CLI}) \tag{9}$$

leaving only the in-phase correlated signals and the independent signals from the other channel.

Figure 5A:
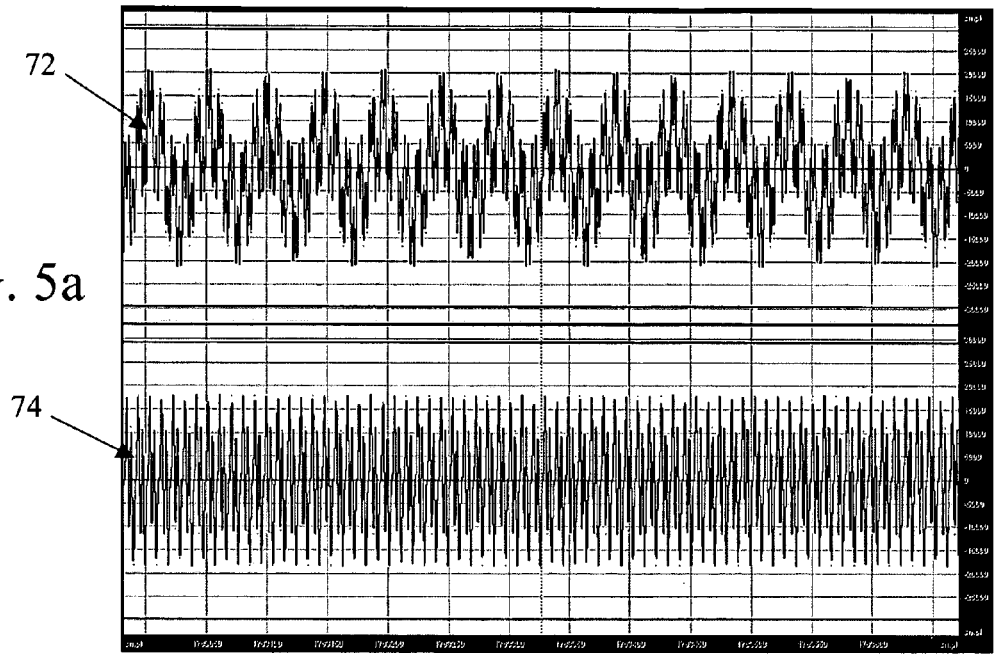
FIGS. 5*a* through 5*h* are simplified diagrams showing time and frequency domain representations of the L and R input channels and frequency domain representations of 2:1 and 4:1 correlated outputs.
Figure 5D:
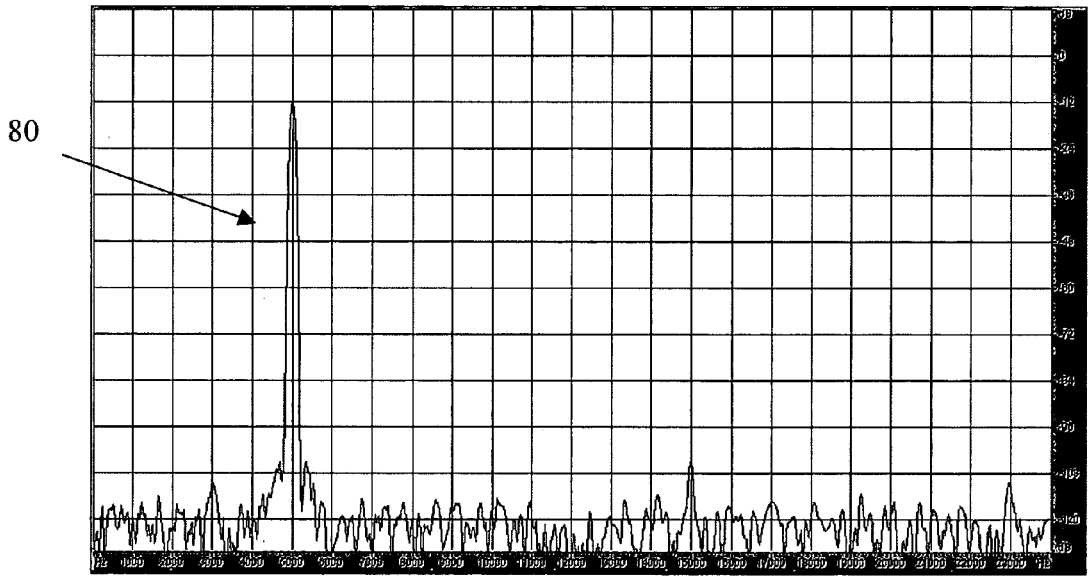
Figure 5B:
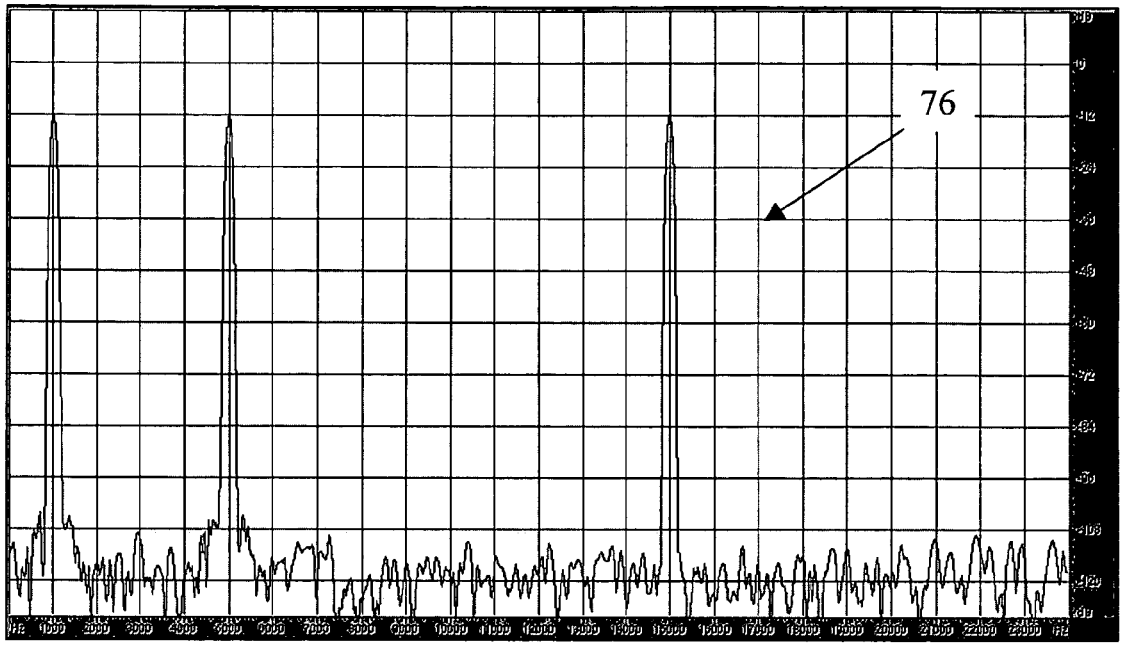
Figure 5C:
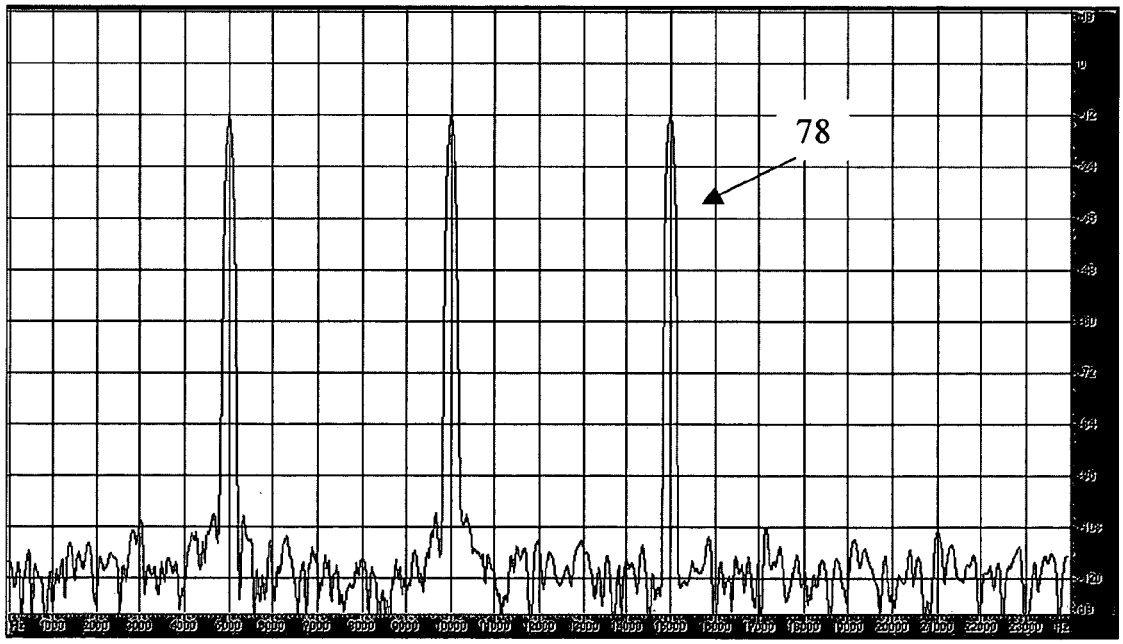
Figure 5E:
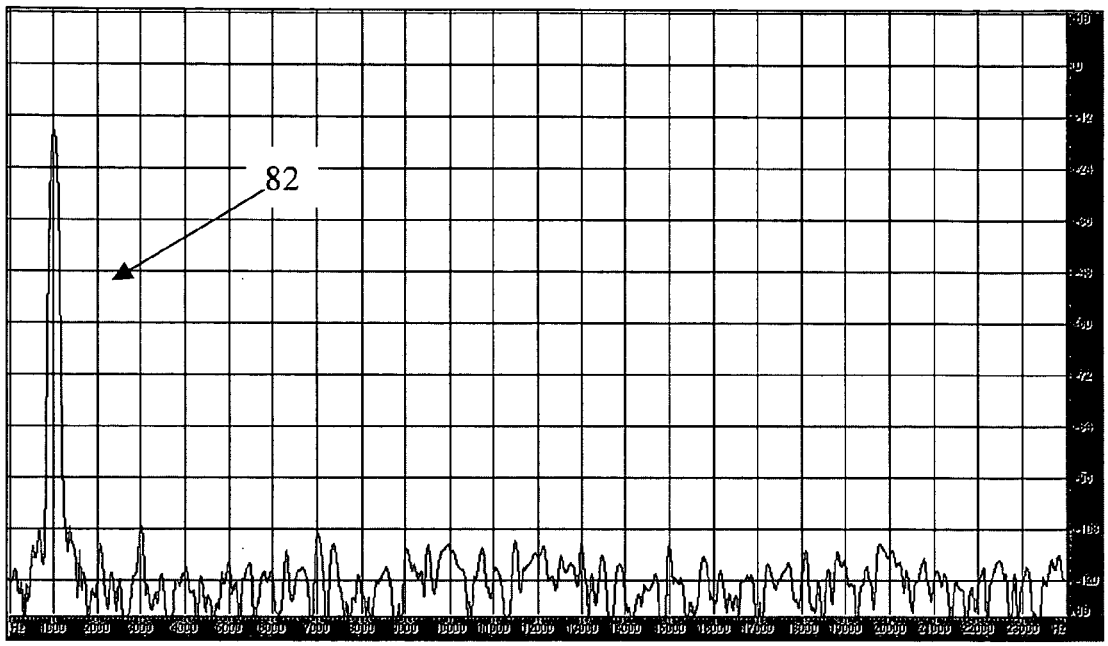
Figure 5F:
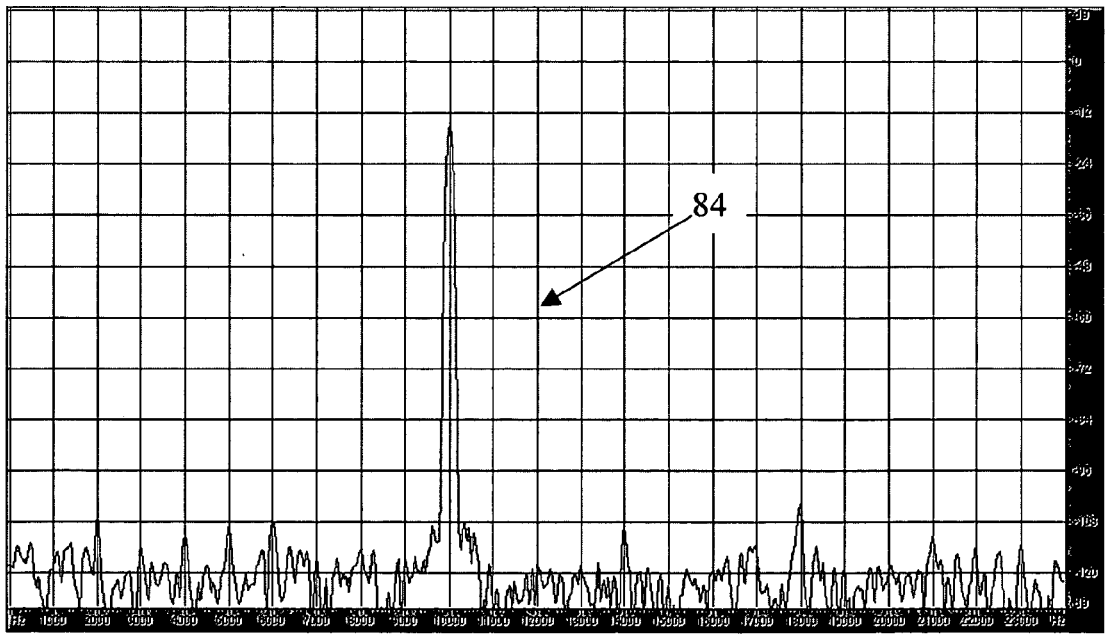
Figure 5G:
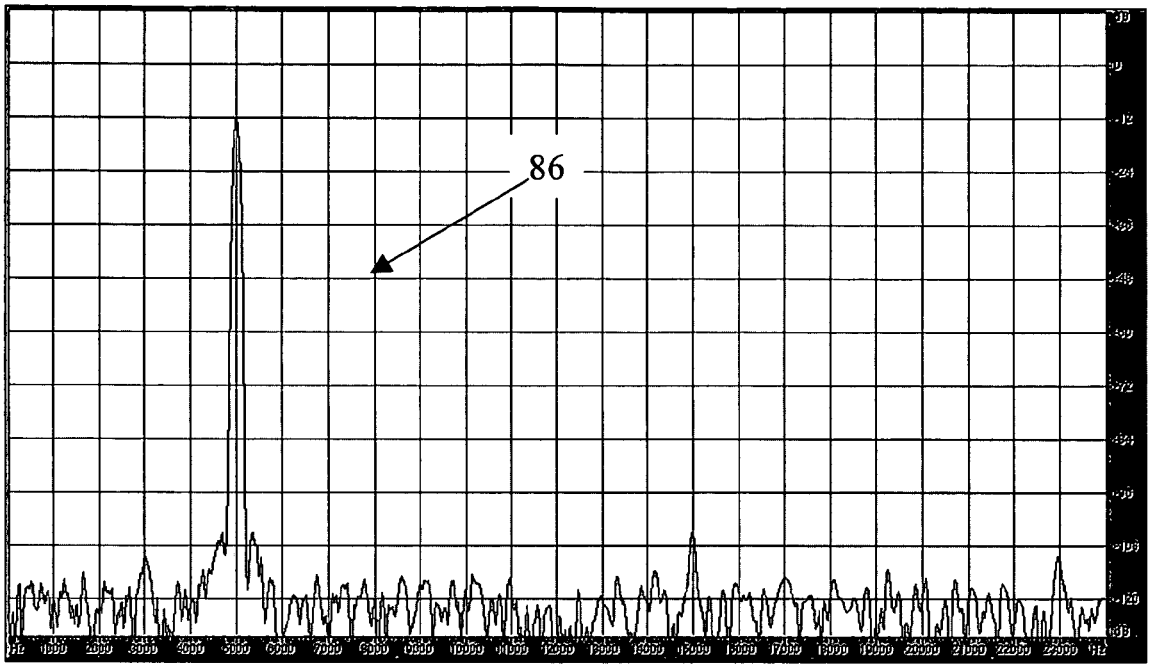
Figure 5H:
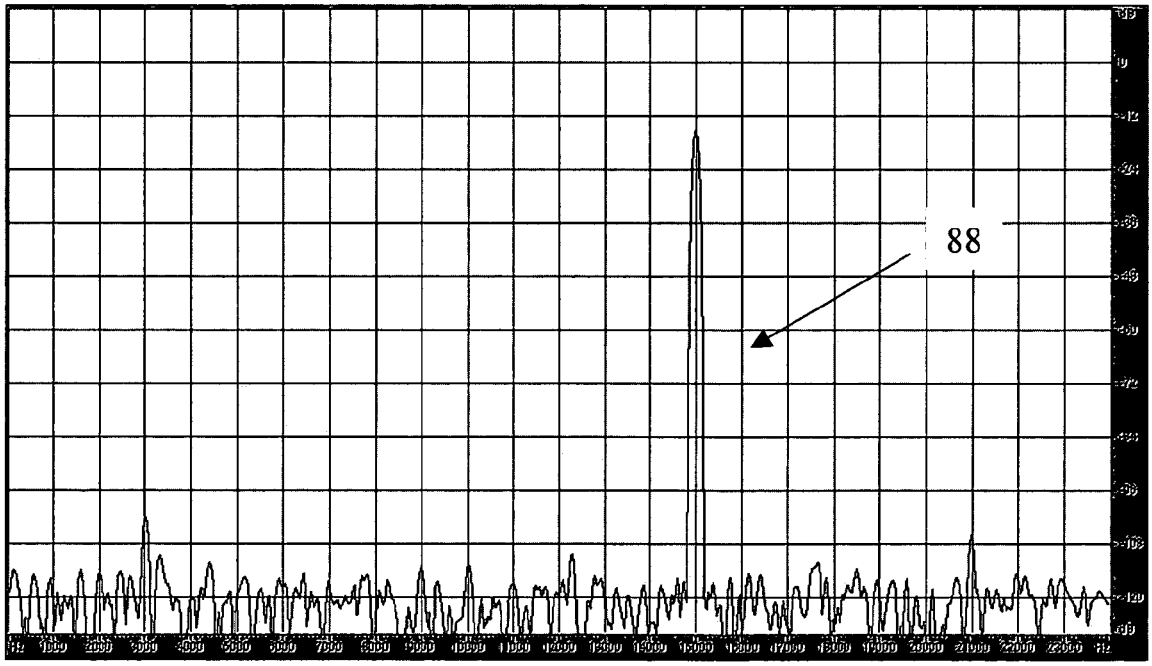

FIGS. 5*a* through 5*h* illustrate a simple four tone example highlighting the benefits and flexibility provided by mixing correlated outputs. In this example, the L channel includes a 1 kHz tone, a 5 kHz tone and a 15 kHz tone. The R channel has a 5 kHz tone, a 10 kHz tone and a 15 kHz tone. The 5 kHz tones are in phase and correlated. The 15 kHz tones are out of phase. The time domain waveforms 72 and 74 for the L (top) and R (bottom) channels are shown in FIG. 5*a*. The frequency content 76 and 78 of the L and R channels are shown in FIGS. 5*b* and 5*c*, respectively.

A 2:1 correlator of the type illustrated in FIG. 3 above, produces a single in-phase correlated audio signal 80 as shown in FIG. 5*d*. This signal can then be mixed with either or both the left and right channels to rebalance the 5 kHz tone without introducing any phase or amplitude distortions associated with the out-of-phase 15 kHz tones or mixing in any of the independent audio signals, 1 kHz into the R channel or 10 kHz in the L channel.

A 2:4 correlator of the type illustrated in FIG. 4 above, produces an independent L signal 82 at 1 kHz, independent R signal 84 at 10 kHz, in-phase correlated signal 86 at 5 kHz, and an out-of-phase correlated signal 88 at 15 kHz as shown in FIG. 5*e*–5*h*. These signals can then be independently mixed with either or both the left and right channels. In some cases only the in-phase correlate signal 86 will be mixed and the other discarded or set to zero. Alternately, the mixer may prefer to add a small component of these other signals. For example, in a 3:2 downmix in which the C channel does not have a discrete speaker, it may be necessary to mix some of the independent signals.

Correlator Implementations

Matrix Decoder

As mentioned above, the correlator may be implemented using a matrix decoder. The earliest multi-channel systems matrix encoded multiple audio channels, e.g. left, right, center and surround (L,R,C,S) channels, into left and right total (Lt,Rt) channels and recorded them in the standard stereo format. The Prologic encoder 4 matrix encodes this mix as follows:

$$Lt=L+0.707C+S(+90°), \text{ and} \tag{10}$$

$$Rt=R+0.707C+S(-90), \tag{11}$$

A matrix decoder decodes the two discrete channels Lt,Rt and expands them into four discrete reconstructed channels L,R,C and S that are amplified and distributed to a five speaker system. Many different proprietary algorithms are used to perform an active decode and all are based on measuring the power of Lt+Rt (C), Lt−Rt (S), Lt (L) and Rt (R) to calculate gain factors Hi whereby, $$L=H1*Lt+H2*Rt \tag{12}$$

$$R=H3*Lt+H4*Rt \tag{13}$$

$$C=H5*Lt+H6*Rt, \text{ and} \tag{14}$$

$$S=H7*Lt+H8*Rt. \tag{15}$$

More specifically, Dolby Pro Logic provides a set of gain factors for a null point at the center of a five-point sound field. The Pro Logic decoder measures the absolute power of the two-channel matrix encoded signals Lt and Rt and calculates power levels for each of the L, R, C and S channels. These power levels are then used to calculate L/R and C/S dominance vectors whose vector sum defines a single dominance vector in the five-point sound field from which the single dominant signal should emanate. The power levels and dominance vectors are time averaged to improve stability. The decoder scales the set of gain coefficients at the null point according to the dominance vectors to provide gain factors Hi.

DTS Neo:6 decoder includes a multiband filter bank, a matrix decoder and a synthesis filter, which together decode Lt and Rt and reconstruct the multi-channel output. Neo:6 computes L/R and C/S dominance vector for each subband and averages them using both a slow and fast average. Neo:6 uses the dominance vector to map the Lt, Rt subband signals into an expanded 9-point sound field. Neo:6 computes gain coefficients for the vector in each subband based on the values of the gain coefficients in the sound field. This allows the subbands to be steered independently in a sound field that observes the motion picture channel configuration.

Matrix Decoder as a Correlator

Figure 6:
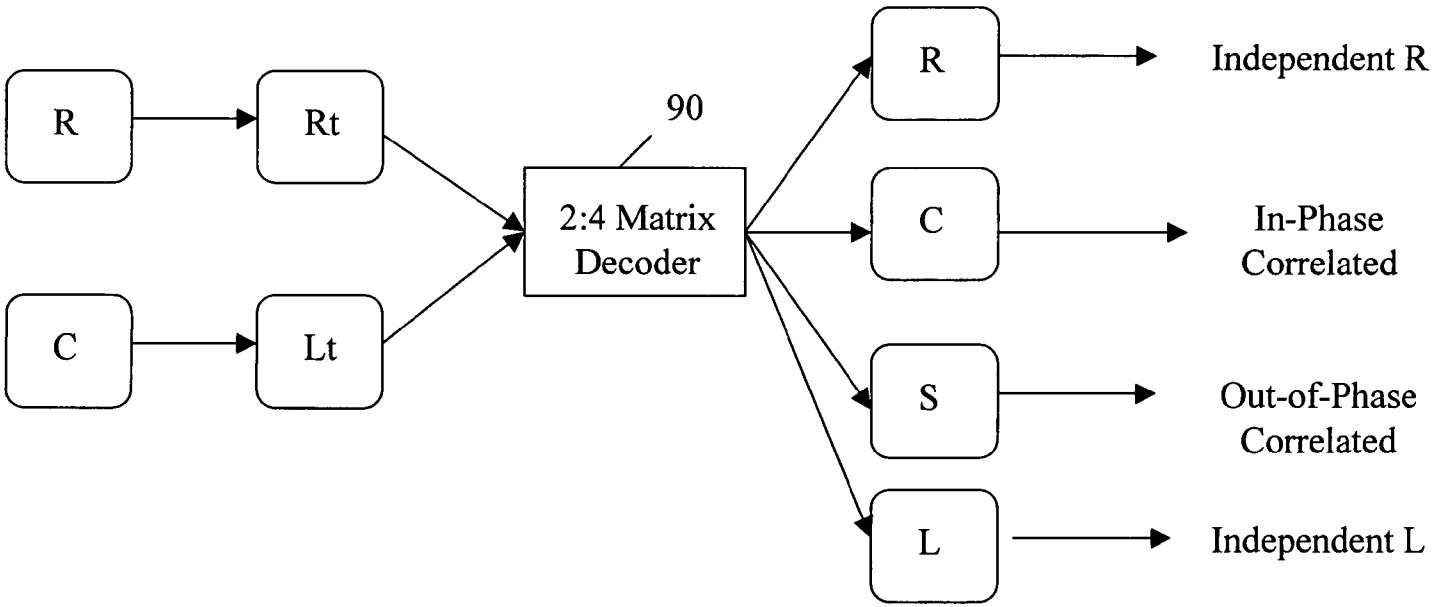
FIG. 6 is a block diagram of an embodiment of the correlator using a 2:4 matrix decoder.

As shown in FIG. 6, a 2:4 matrix decoder 90 is designed to deconstruct Lt and Rt to reconstruct the L, R, C and S channels as encoded in equations 10 and 11. An analysis of these equations shows that the L and R channels are independent in Lt and Rt, the C channel is perfectly correlated and the S channel is 180° out-of-phase.

Therefore, as shown in FIG. 6, if Lt and Rt are simply two audio channels, and not matrix encoded channels, then the reconstructed C channel will represent any in-phase correlated audio signals in Lt and Rt, the reconstructed S channel will represent any out-of-phase correlated audio signals and the reconstructed L and R channels will represent independent audio signals from the two input audio channels. Note, a 2:3 matrix decoder in which the S channel is mixed into the L and R channels can be used if only the in-phase correlated signal is required.

The specific algorithm used to calculate the gain factors Hi will determine the degree of correlation, phase shift or independence captured in each of these channels. To illustrate, consider the following idealized cases:

| Case 1: Lt, Rt highly correlated (Lt = Rt) |
|---|
| L H1 and H2 = 0.354, −0.354,<br>C H1 and H2 = 0.707, 0.707,<br>R H1 and H2 = −0.354, 0.354,<br>S H1 and H2 = 0.707, −0.707, |

In this case, L, R and S will be 0 and C will contain equal amounts of both L and R. As expected, in-phase contribution will be large and the other components will be zero. Depending on where the steering vector ends up new coefficients are calculated from a grid of optimal ones using interpolation

| Case 2: Lt, Rt complete out of phase (Lt = −1.0*Rt) |
|---|
| L G1 and G2 = 0.354, 0.354,<br>C G1 and G2 = 0.5, 0.5,<br>R G1 and G2 = 0.354, 0.354,<br>S H1 and H2 = 0.707, −0.707, |

In this case, all of the outputs will be zero.

| Case 3: Lt is dominate (Rt = 0) |
|---|
| L H1 and H2 = 1.0, 0.0,<br>C H1 and H2 = 0.0, 0.5,<br>R H1 and H2 = 0.0, 0.707,<br>S H1 and H2 = 0.0, −1, |

In this case, all of the outputs are zero except for the left channel which contains the left input.

Multi-Channel Automotive Audio System

As discussed above the motivation for the present invention was to improve the surround sound experience provided by multi-channel audio such as provided by Dolby AC3 or DTS Coherent Acoustics. By mixing correlated audio signals, the multi-channel mixer provides the desired rebalanced of the multi-channel audio without producing unwanted artifacts or softening the discrete presentation of the audio.

Figure 7:
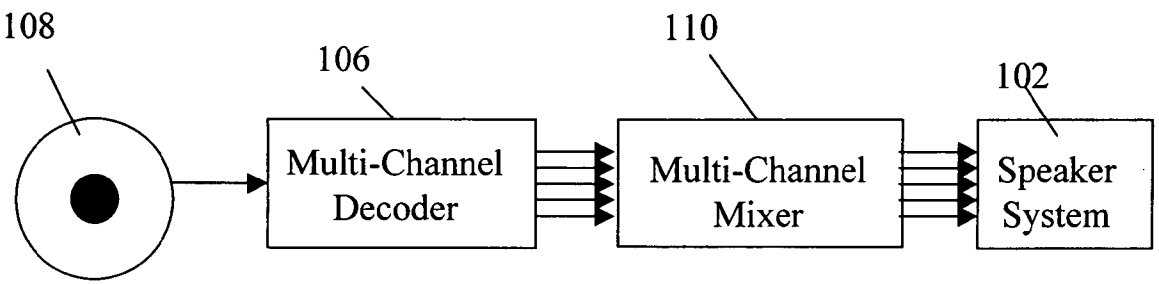
FIG. 7 is a simplified block diagram of an automobile audio system.
Figure 8:
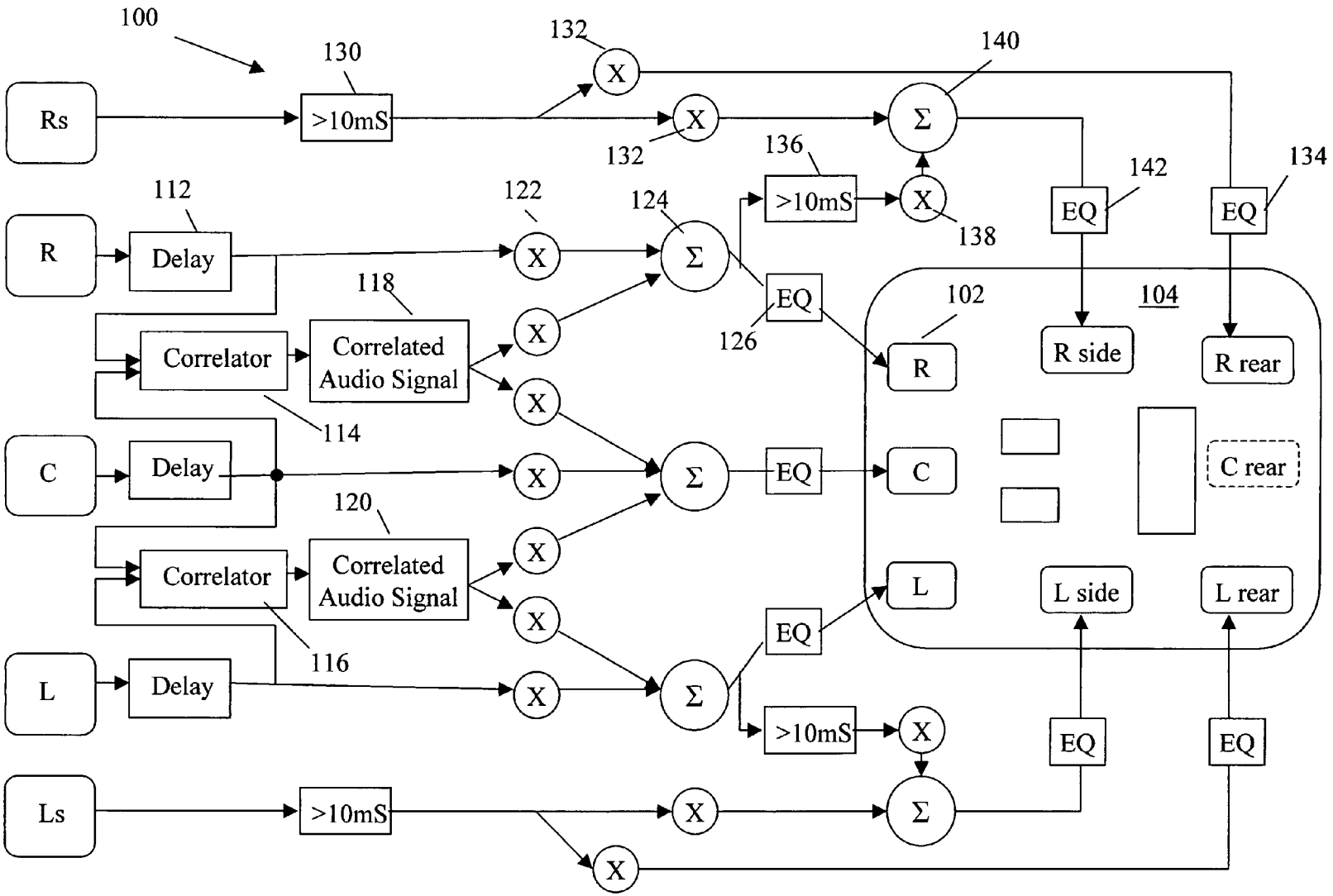
FIG. 8 is a block diagram of the multi-channel mixer.

As shown in FIGS. 7 and 8, a typical automotive sound system 100 a plurality of speakers 102 including at least L front and R front in the passenger cabin 104 of the car. In this example, speaker system also includes C front, R and L side and R and L rear and may include a C rear. A multi-channel decoder 106 decodes multi-channel encoded audio from a disk 108 (or broadcast) into multiple discrete audio input channels including at least L front, C front and R front. In this 5.1 channel format right Rs and left Ls surround channels are also provided. The 0.1 or low frequency channel is not shown.

A multi-channel mixer 110 mixes the discrete R,C,L channels using correlated outputs into the R,C,L channels for the respective speakers. Each channel is passed through a delay 112. The R and C and L and C channels are input to correlators 114 and 116, respectively, which generate correlated audio signals 118 and 120. These correlated audio signals 118 and 120 are mixed (multiplied by gain coefficients Gi 122 and summed 124) with the adjacent channels. The mixed channels are passed through equalizers 126 to the R,C, L output channels for playback on the R,C,L channel speakers.

In this particular application 5.1 audio is being mixed into a 7 speaker system, which is not uncommon. Because of typical home speaker configurations, 5.1 content is more common but many cars use 7 speaker systems. In this case the Rs and Ls discrete channels are mixed to the R side and R read and L side and L rear, respectively. The Rs (Ls) channel is passed through a delay 130, split and multiplied by mixing coefficients 132. One branch is passed through an equalizer 134 and provided to the R read (L rear). The other branch is mixed with the mixed R (L) channel (delay 136, mixing coefficient 138, and summing node 140), passed through an equalizer 142 and provided to the R side (L side).

If the content were provided in a 7.1 format, the R, R side and R rear discrete audio channels could be mixed using correlated outputs in a manner similar to that described for the R,C,L. The left side channels could be similarly mixed. Furthermore, if the audio was available in an 8.1 format and the speaker system included a C rear speaker, all of the rear speakers could be so mixed.

Figure 9:
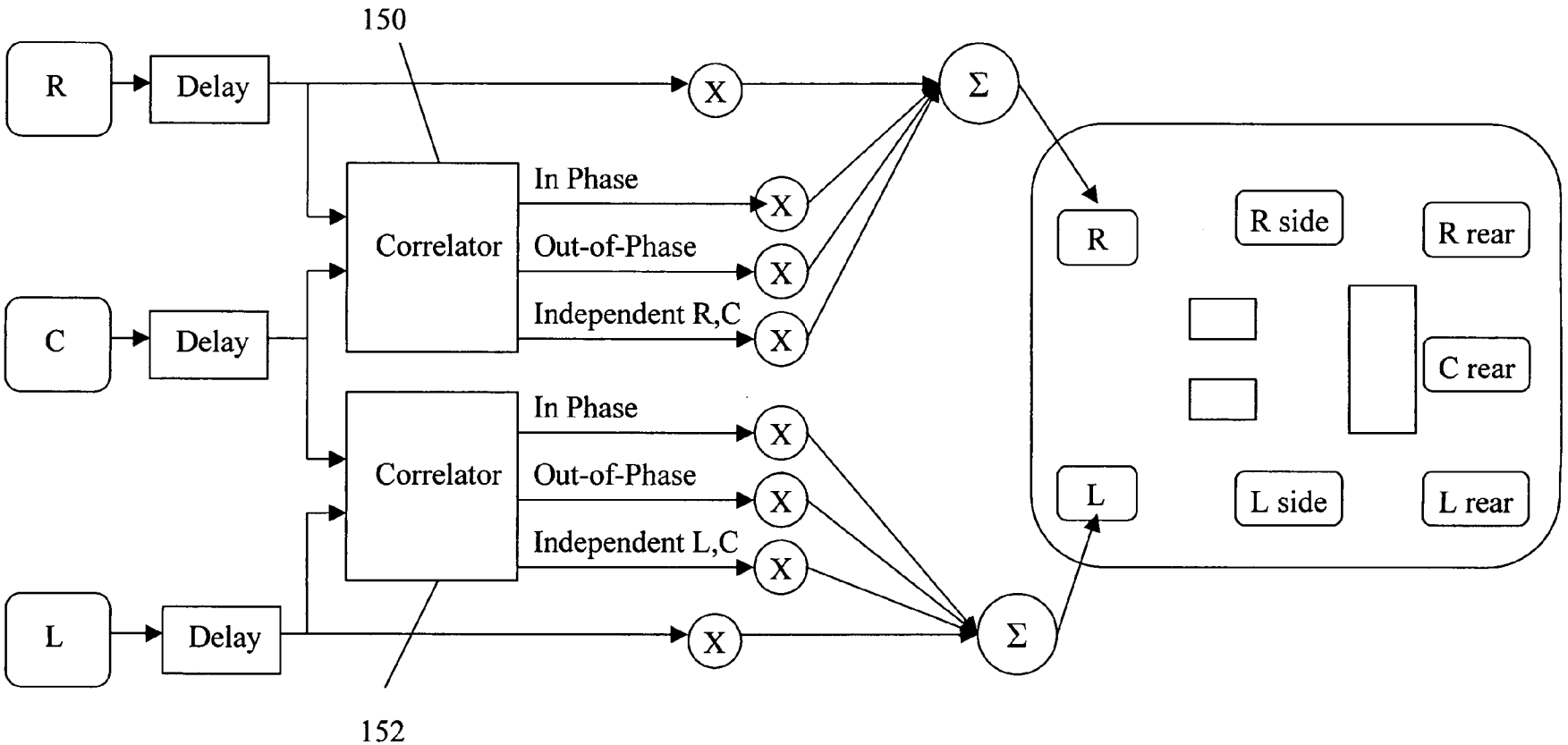
FIG. 9 is a block diagram of the multi-channel mixer that exploits the downmix capabilities of the correlator shown in FIG. 4 in an automobile.

As shown in FIG. 9, the speaker system in the car is not provided with a C front speaker. The 3 front channels (R,C,L) must be downmixed into only 2 channels (R,L). This is a common occurrence in non-automotive applications where the C channel speaker does not exist. The C channel is simply mixed into both the L and R speakers. In the automotive setting, the same approach can be taken. However, the ideal coefficients for mixing the C channel may not be the same as the desired coefficients for rebalancing and further may create unwanted artifacts do to the out-of-phase correlated signals between the input channels.

Instead, the correlators 150 and 152 generate the in-phase, out-of-phase, and pair of independent audio signals. The mixer now has the flexibility to mix the in-phase components as needed to rebalance the signal, discard the out-of-phase components to avoid phase distortion and mix the independent C channel to preserve the audio signals in that channel.

The capability to flexibly downmix N channels into M where N>M in this manner will have applicability outside automotive applications. For example, content is being generated for new exhibition venues with more discrete channels, e.g. 10.2. However, many of the commercial and consumer venues will have 5.1, 6.1 or 7.1 speaker configurations that will require downmixing.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. An audio mixer, comprising:

a decoder that receives multi-channel encoded audio data and outputs multiple discrete audio input channels including at least left (L), center(C) and right (R) channels, a first matrix decoder that matrix decodes the R and C channels to produce a first in-phase correlated audio signal;

a first mixer that mixes the first in-phase correlated audio signal with the R input channel into a R output channel;

a second matrix decoder that matrix decodes the R, L and C channels to produce a second in-phase correlated audio signal; and a second mixer that mixes the second in-phase correlated audio signal with the L input channel into a I output channel.

2. The audio mixer of claim 1, wherein said first and second matrix decoders comprise 2:3 decoders that output left and right channels that are discarded and a center channel that provides the in-phase correlated audio signal.

3. The audio mixer of claim 1, wherein said first and second matrix decoders comprise 2:4 decoders that output left and right channels that provide R and C and L and C independent audio signals, respectively, output a center channel that provides the in-phase correlated audio signal, and output a surround channel that provides an out-of-phase correlated audio signal that is discarded. correlated signal and first and second independent signals.

* * * * *

UNITED STATES PATENT AND TRADEMARK OFFICE

CERTIFICATE OF CORRECTION

PATENT NO. : 7,283,634 B2
APPLICATION NO. : 10/930659
DATED : October 16, 2007
INVENTOR(S) : William Paul Smith It is certified that error appears in the above-identified patent and that said Letters Patent is hereby corrected as shown below:

Col. 8 lines 25-41 should read
Claim 1:
an audio mixer, comprising:
a decoder that receives multi-channel encoded audio data and outputs multiple discrete audio input channels including at least left (L), center (C) and right (R) channels,
a first matrix decoder that matrix decodes the R and C channels to produce a first in-phase correlated audio signal:
a first mixer that mixes the first in-phase correlated audio signal with the R input channel into a R output channel,
a second matrix decoder that matrix decodes the L and C channels to produce a second in-phase correlated audio signal; and
a second mixer that mixes the second in-phase correlated audio signal with the L input channel into a L output channel.

Signed and Sealed this

Seventh Day of July, 2009

JOHN DOLL
*Acting Director of the United States Patent and Trademark Office*